United States Patent [19]

Platt

[11] Patent Number: 4,890,428

[45] Date of Patent: Jan. 2, 1990

[54] PARTITION CLIP

[75] Inventor: William J. Platt, Collingdale, Pa.

[73] Assignee: National Rolling Mills, Inc., Malvern, Pa.

[21] Appl. No.: 240,169

[22] Filed: Sep. 2, 1988

[51] Int. Cl.[4] ..... E04B 1/38

[52] U.S. Cl. ..... 52/238.1; 52/484

[58] Field of Search ..... 52/484, 489, 357–360, 52/714, 715, 243.1, 236.9, 370, 714

[56] References Cited

U.S. PATENT DOCUMENTS 3,387,872 6/1968 Lovullo et al. ..... 52/714
3,420,019 7/1969 Padilla ..... 52/714
3,499,257 3/1970 Heverley et al. ..... 52/714
3,589,660 6/1971 Dunckel ..... 52/714

FOREIGN PATENT DOCUMENTS 912611 12/1962 United Kingdom ..... 52/484

*Primary Examiner*—James L. Ridgill, Jr.
*Attorney, Agent, or Firm*—Eugene Chovanes

[57] ABSTRACT

A clip for securing the top channel of a partition wall to a beam of a continuously extending suspended grid ceiling. The clip has a flat base and diagonally positioned hooks on the base. The clip is applied to the beam by rotating the hooks onto the beam flanges where the clip is locked in place by locking tabs on the base.

3 Claims, 4 Drawing Sheets

FIG.3
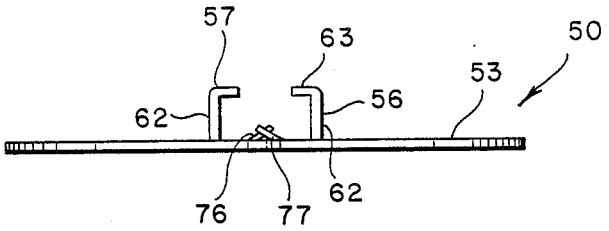
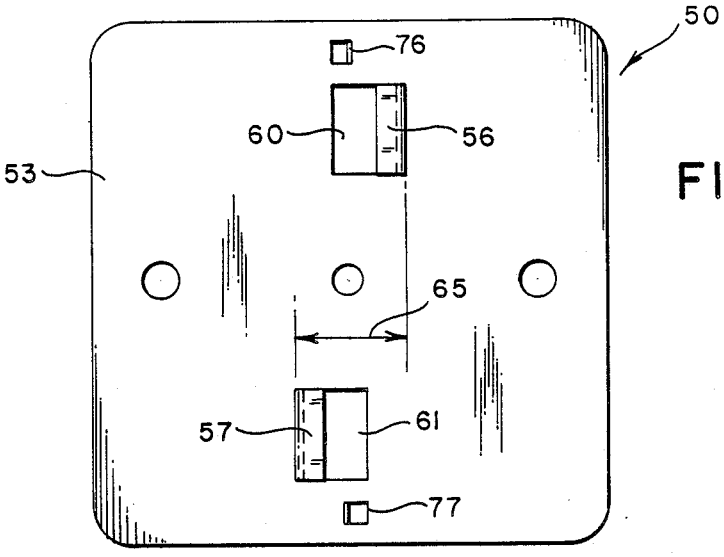
FIG.4
FIG.5
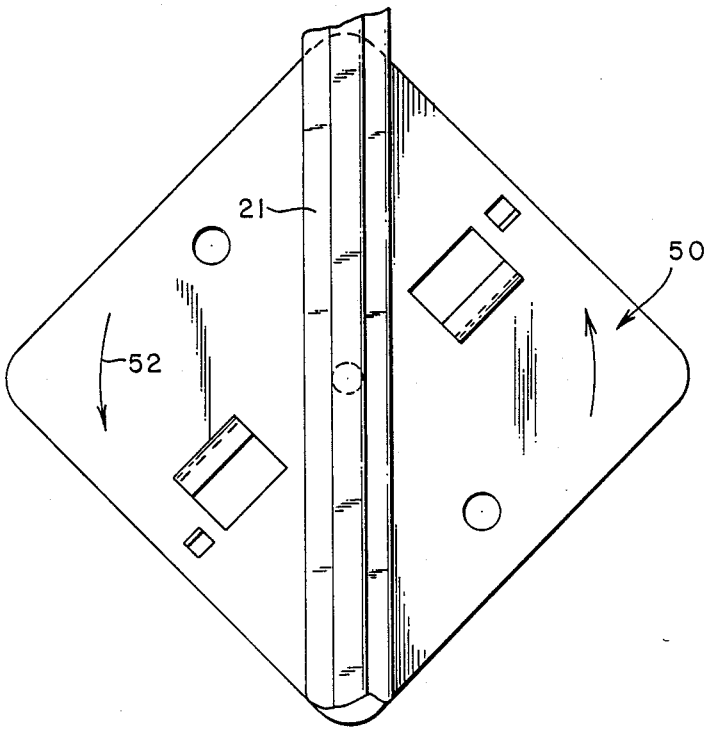

PARTITION CLIP

FIELD OF THE INVENTION

The invention relates to dropped ceilings of the grid type wherein metal runners are suspended from a structural ceiling. The runners are arranged in grid fashion to receive acoustical tiles supported by and located within the runners generally in the form of inverted T-shapes in cross section.

BACKGROUND OF THE INVENTION

Extensive use is made of suspended ceilings which are suitably supported below a structural ceiling in primarily industrial and commercial construction.

The suspended ceiling is formed of interlocking grid beam members generally of an inverted T-cross section. Such beam members are generally formed of strip steel suitably bent to provide a vertically extending web section, horizontally extending shoulders or flanges at the bottom of the web section, and a suitable reinforcing box member at the top of the web. Numerous different design interlocking structures are used to provide, when assembled, grid or structural members which are then supported from the structural ceiling by, for instance, a plurality of wires which are secured through holes in the web of the beam at the lower end and to anchors in the structural ceiling at the upper end. Acoustical tiles in the form of rectangles or squares are supported within and by the structural members whereby a suspended ceiling is formed below the structural ceiling.

Panel lighting, heating and ventillating units can also be suitably located within and supported by the suspended ceiling.

The grid supporting structure of beams described above was generally formed within the vertical walls of the individual rooms of the finished building. Such walls included structural walls as well as interior partition walls. The suspended grid structure generally terminated at the edge of and within both the structural and partition walls. A wall molding having an angle cross section supported the grid beams. An upper extending leg of the angle was fastened against the wall and the horizontal extending angle formed a ledge or flange which received and supported the lower T-section of the beam.

The result was generally a plurality of individual suspended ceilings, with each room having in effect its individual ceiling unconnected with the ceiling in the adjacent room.

In constructing such ceilings, it has been the general practice to create interior partition walls which extend vertically to at least a height of the proposed suspended ceiling, and often above such height up to the structural ceiling. These partition walls were customarily erected prior to the construction of the suspended ceiling and in most instances, the partition walls were used to additionally support the suspended ceiling wherein the suspended ceiling was formed within the perimeter of the structural walls and the partition walls, as described above.

Rooms within buildings are often changed after the initial construction. Frequently, interior walls are removed and replaced to provide varying space. In the past, when walls were removed and replaced, the various individual suspended ceilings within the room generally were affected since the ceilings frequently terminated at the former partition wall line. This left a gap corresponding to the former wall thickness extending in the ceiling at the old partition line. Additionally, the suspended beam structure above the new partition wall line interfered with the conventional construction practice since the suspended ceilings were put in after the partition walls were erected rather than before. Also, since the partition walls were removed, the wall molding was also removed, leaving the beam ends unsupported.

In summary, conventional practice has generally required interior partition walls to be erected first and the suspended ceiling to be placed within the partition walls. Any change in partition walls required the old ceilings to be removed and new ceilings to be erected within the walls.

There have been efforts in the prior art to provide suitable devices for connecting partition walls at their top to continuously extending structural grid members. Such connection, in one instance, consists of a formed strap member which in effect draped over the entire T-section in the form of an inverted U over the web with horizontal ears which extend outwardly from the arms of the U, approximately at the level of the flange of the inverted T-section. The walls were then secured to this, in effect, strap hanger.

In another instance, where the flange of the inverted T was in the form of a channel, a member having a lower indented clip portion snapped into the boxlike flange of the inverted T structural member, while the remaining portion of the clip wrapped around one side of the flange box channel.

In both such connections, placing the connection element in position involved a tedious operation, and the connector itself lacked an easily accessible, firm and compact anchor portion.

With the straplike arrangement, it was inconvenient to connect the channel to the strap since, when the connecting sheet metal screw was forced up into the ears of the strap, the strap simply snapped off the web portion and lifted up. Additionally, where the walls ran perpendicularly, or across, a given suspended beam structure, the strap had a tendency to slip longitudinally along the web of the suspended beam structure, causing the wall to move laterally with respect to the beam, whereby the top of the wall shifted.

In yet another early attempt to anchor partition walls at the tops thereof from a suspended beam grid element, where the flange was in the form of an inverted box channel in cross section, heads with suitably sized bolts were threaded into the channel portions with the thread of the bolt extending downwardly to pass through holes in wall channels. Nuts were then used to secure the channels to the bolts and beam elements. Again, such practice was tedious, and unsatisfactory since the wall again often wobbled laterally of the beam, since the bolts would shift during erection of the wall.

SUMMARY OF THE PRESENT INVENTION

The present invention permits the structural grid beams of a suspended ceiling to be totally and completely erected within a given large space, and then partition walls erected within the large space without affecting the suspended structural beam members. Additionally, subsequent changes in wall location can be achieved without disturbing the suspended structural beam members.

Whereas, in the former practice arrangement, the partition walls were erected first and then the suspended ceilings were located within the partition walls, in the practice of the present invention, the suspended ceiling is first put in place over a large space and then the partition walls are erected to divide the space without affecting the suspended ceiling members.

In the present invention, partition clips are used to interconnect the beams of the suspended ceiling and the partition walls. The present partition clip comprises staggered clip elements integrally formed from a base member. Locking tabs are also formed in the base member. The clip is secured and locked to the beam by a simple rotational movement which can be performed quickly. The base or plate portion of the clip provides a firm, sturdy, neat, compact connecting element which can be readily joined with a horizontally extending inverted sheet metal channel beam of the type commonly used as the upper structural support on a partition dividing wall.

When existing partition walls are removed and relocated within a given space in a building, the partition walls can be readily dismantled without affecting the structural beam members. The procedure for erecting partition walls is simply reversed; that is, the vertical wall is first removed along with the horizontally extending upper channel member of the partition wall. Sheet metal screws that were used to hold the upper structural channel to the clip are simply unscrewed. The clips are then removed by depressing the locking elements and rotating in a reverse direction from application. New walls are erected and connected to the beams by securing clips at the new wall location. Clips can be reused in creating new walls.

The clips are generally of the same overall construction for the various designs of structural beams, except for minor modifications to accommodate the various shaped sizes or flange portions of the suspended T-beam members. Such flange portions can include in cross section a slotted form, or a tier drop form, or a simple straight, flat form of flange, as well as any other form.

BRIEF DESCRIPTION OF THE DRAWINGS

FIG. 3 is an end elevational view of the clip of the invention.

FIG. 4 is a plan view of the clip of FIG. 3.

FIG. 5 is a top plan view of a clip of the invention being secured to a beam member in a suspended ceiling wherein the clip is about to be rotated onto the beam and locked thereon.

DETAILED DESCRIPTION OF THE INVENTION

Figure 1:
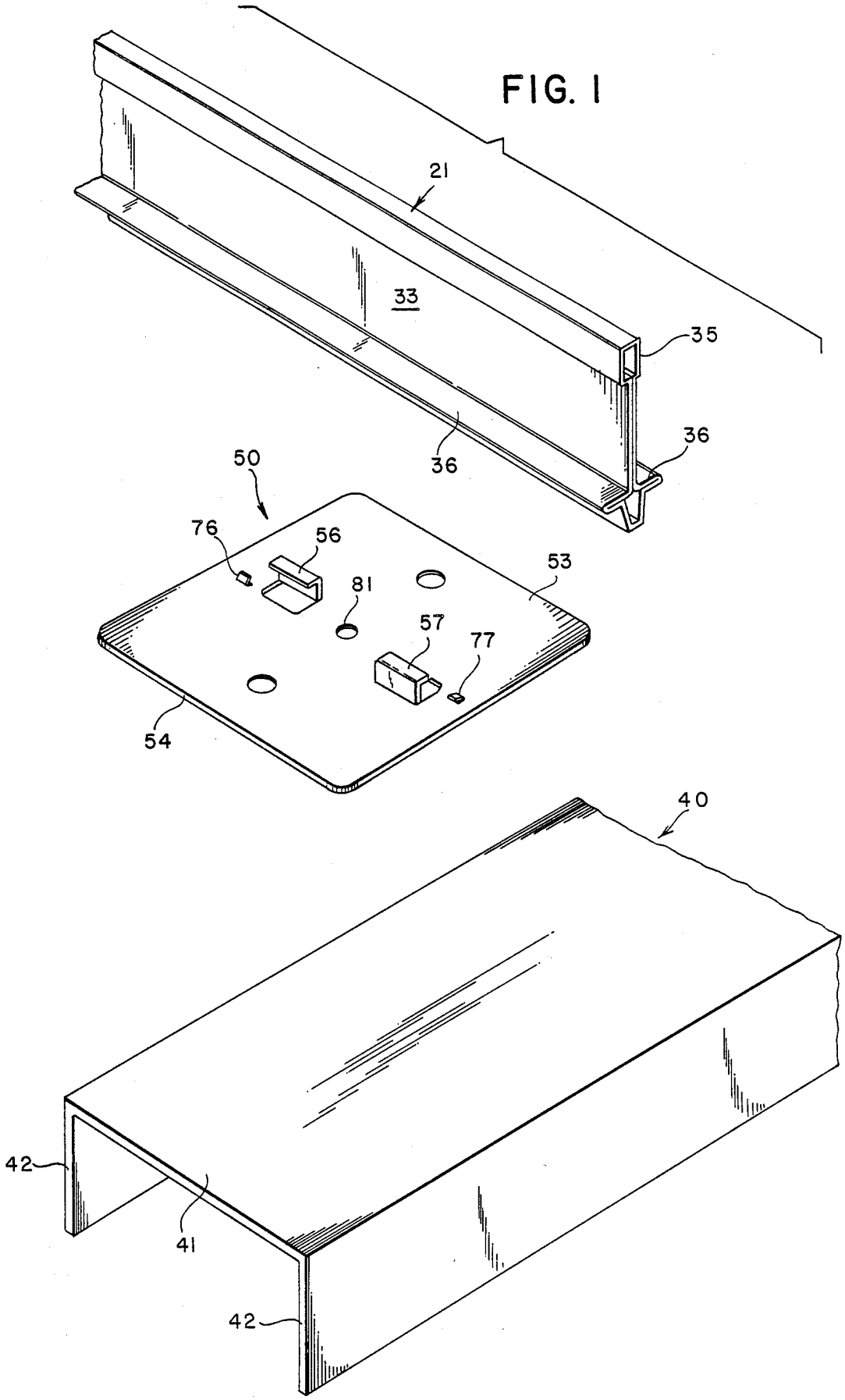
FIG. 1 is an exploded view of the clip of the invention arranged with respect to the grid beam member of the suspended ceiling and the inverted channel at the top of a partition wall wherein the partition wall runs across or transversely to the suspended beam member.

Structural grid elements for suspended ceilings 20 consist of longitudinal extending members 21 and cross members 22. Numerous arrangements are used to cross-connect member 21 and 22 at their joints 23 into a rectangular grid pattern wherein an opening 24 can be for instance 2'×4' in dimension.

Acoustical and lighting and air conditioning elements are supported by and suspended within grid openings 24, in well known prior art fashion.

The entire grid system is suspended from a structural ceiling by wires or hangers (not shown). A wall molding extends around the interior of structural walls and generally in prior art practice, around interior partition walls. Such wall molding 26 generally comprises, for instance, a 1"×1" angle wherein a vertical leg of the wall molding is secured to the wall by anchors with the horizontally extending leg 27 supporting the ends of the members 21 and 22.

In the present invention, interior or partition walls 28 are generally constructed of vertically extending studs formed of sheet metal channels which are suitably anchored at the tops thereof in horizontally extending channels 30 and at the bottom thereof in channel 31 which is suitably anchored to the floor.

Whereas in the prior art the top of partition wall 28 could extend above the suspended grid structure 20 whereby a wall molding 26 would be used on the partition wall to support the grid extending within the room formed by the dividing wall, the present invention contemplates the partition wall terminating at the channel 30 which, as seen in the drawings, is intended to abut against the underside of the continuously extending grid system 20.

Figure 2:
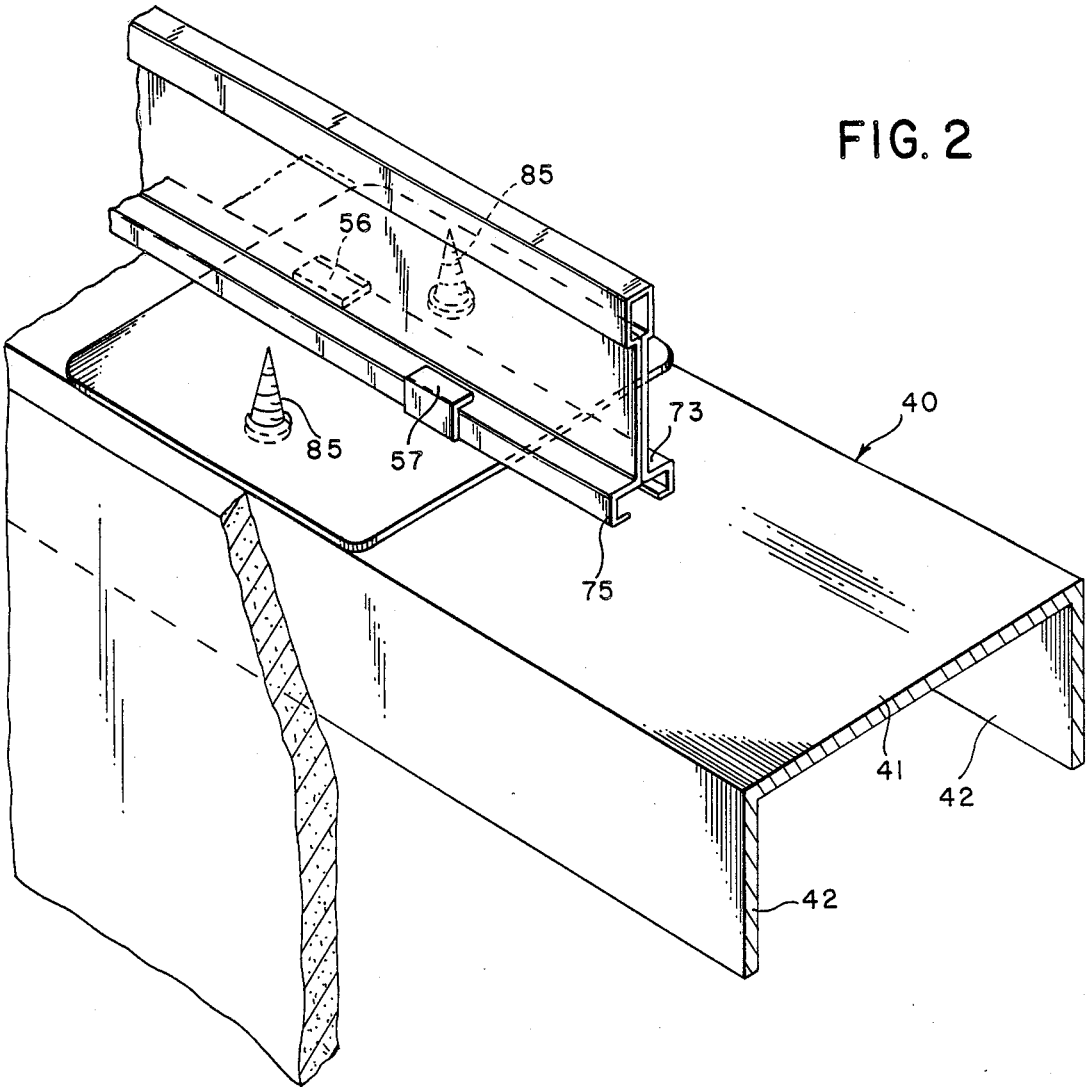
FIG. 2 is a partial perspective view of a structural beam member of a suspended grid ceiling structure having the clip of the invention connected thereto and with an inverted channel member of a partition wall secured to the clip wherein the channel member and the partition wall run parallel to and directly beneath the structural beam member.

As seen in detail in FIGS. 1 and 2, an individual main runner 21 is formed of a vertically extending web portion 33 and upper reinforcing box portion 35 and a lower horizontally extending flange portion 36. Such beam elements of course vary in their details of construction and are well known and much used.

Figure 1A:
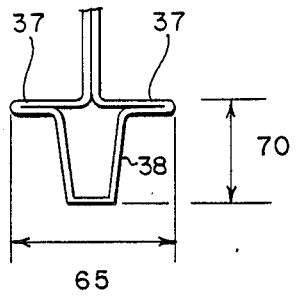
FIG. 1*a* is a fragmentary section of a beam.

For illustrative purposes, there is shown in FIG. 1*a* what can be termed a "tier drop" design wherein flange 36 is formed of horizontally extending shoulders 37 and a downwardly depending closed channel section 38 which resembles in cross section a tier drop. Such a configuration provides not only an aesthetically pleasing effect when viewing from below in the finished ceiling, but also provides structural rigidity to the beam member at the lower flange portion since an open box construction is known to impart substantial resistance to a bending force.

In the construction of the partition wall, a top channel member 40 having a web portion 41 and downwardly depending arm portions 42 is used at the top of the wall.

Both the structural beam member 21 and the wall channel 40 are conventional prior art items.

The present invention is directed to the clip 50 which securely connects the channel 40 and beam element 21. The clip 50 is first secured to beam element 21 by rotating the clip in counterclockwise fashion 52 to connect with beam 21. Clip 50 comprises a base portion 53 which is simply a rectangular section of sheet steel of a gauge, for instance, 0.020". Base 53 is of square shape of, for instance, a 3 ⅜" dimension per side 54. The side dimension is intended to be slightly less than the partition wall thickness so that the base 53 of clip 50 lies entirely within the finished wall and is not visible from within a room. Since the base 53 of the clip 50 is square, the same effect is achieved whether the wall is run beneath and along member 21 as seen in FIG. 2 or whether it is run across or transverse to member 21, as would be the case in FIG. 1 with the wall in assembled condition.

Clip 50 has formed therein opposing hook elements 56 and 57 which are suitably stamped out of base 53 and formed therefrom, leaving rectangular openings 60 and 61. Hooks 56 have a vertically extending leg 62 and a horizontally extending hook portion 63. The legs 62 are spaced a distance 65 as seen in FIG. 4. Distance 65 conforms to the flange width as seen for instance in FIG. 1*a*. Of course, such flange distance will vary depending on the cross section of the grid beam design, but virtually all such cross sections are in the form of a T or modified T, and hook spacing 65 conforms to the outside dimension across the flange of the T.

The length of the hooks 56 and 57 can be for instance ⅝" in length but any variance from that is acceptable providing the clip remains stable when affixed to the beam. The height of the hook portion 53 above the base is, for instance in one embodiment, 0.3" which conforms to the distance 70 as seen in FIG. 1*a*. Again, such distance will vary depending on the cross-sectional configuration of the structural beam member. For instance, there is shown in FIG. 2 a slot configuration flange 73 wherein the height 75 of the open box channel is also 0.310", so that the height of the hook 63 above base 53 would be the same. Thus, for the beam shapes of FIGS. 1 and 2, the same configured and distanced hooks in the clip could be used.

Locking tabs 76 and 77 are also formed in the base of the clip in a position wherein the tabs will lock against the edge of the tier drop of the type shown in FIG. 1, or against the interior of the slot flange as seen in FIG. 2. The specific locking arrangement is shown more clearly in FIG. 1*a* with respect to the tier drop design and in FIG. 2 with respect to the open slot design.

Figure 6:
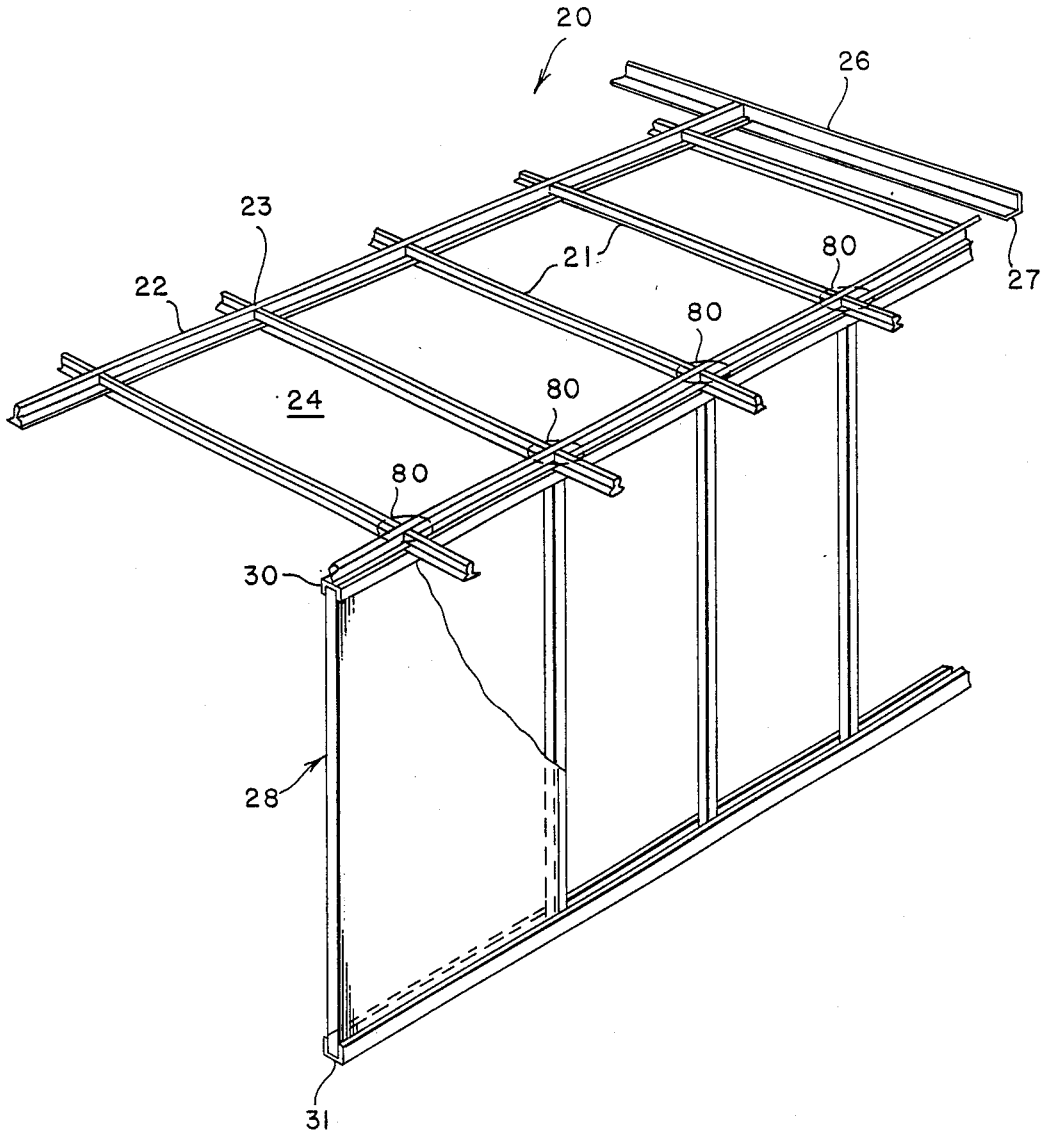
FIG. 6 is a partial perspective view of a suspended ceiling grid system showing a partition wall located beneath the system to indicate where the clips of the invention are utilized. In this view, the partition wall runs across existing ceiling beam elements in the manner shown in FIG. 1.

As indicated above, in assembly the structural grid 20 is either put in place or already exists above the space to be subdivided with partition walls. The location of the partition walls is then determined and the location of the panel member at the top of the partition wall is suitably indicated as by a chalk line on the structural beam members of the suspended grid system. These locations would conform, for instance, to locations 80 as seen in FIG. 6. A clip 50 of the invention would then be secured to the designated beams by placing base 53 against the flange portion 36 of the beam 21, wherein the hooks 56 and 57 in the clip would straddle the beam and the base would be oriented in a diagonal fashion as shown in FIG. 5. The clip 50 would then be rotated in the horizontal plane in the manner shown in FIG. 5 until hook elements 56 and 57 hook onto flange portions 36. The hook portions 63 are slightly depressed as seen in FIGS. 1*b* and 2*a* whereby there is a spring action wherein the hooks 56 and 57 give while being finally seated after which the hooks 56 and 57 spring back and resiliently and firmly grip the flange 36.

Meanwhile, locking tabs 76 yield until clip 20 is rotated into its final position, at which point locking tabs 76 spring back into a position which prevents counterrotation of the locking slip 50. Clip 50 is then locked in place on the beam 36 in a line conforming to the partition wall 28 location.

Optionally, a sheet metal screw can be inserted upwardly through hole 81 and the flange 36 in either the tier drop design of FIG. 1 or the slot design of FIG. 2 or any other flange design including a straight flat flange portion. Such screw connection provides additional security, but it has been found not necessary in most instances.

A top channel 40 is then positioned in line with and centered on clips 50. Sheet metal screws 85 are driven up through the web 41 of channel 40 into and through base 53 of clip 50 thereby securing the channel to the clip which is in turn secured to the structural beam members.

A corresponding floor channel is secured directly below the top beam channel and studs are located vertically between and into the channel in conventional prior art fashion.

Suitable wall covering is placed over the studs in the form of, for instance, sheet rock which is then finished.

In the event it is desired to relocate the interior walls so constructed, it is merely necessary to remove the wall covering, the vertical studs, and the channels in reverse order from that used in construction. The clips 50 are then removed in clockwise direction, by rotating the clips 50 as seen in FIG. 5. It is necessary to disengage locking tabs 76 from the flange in order to initially permit such clockwise rotation. This can be achieved by use of a screw driver or other sharp instrument which is inserted between the flange and the clip to depress or separate the tab from the flange. When the clip is rotated into the position shown in FIG. 5, the clip 50 can be removed. The walls can then be relocated at a new location by following the procedure enumerated above.

In addition to running walls along a beam or across a beam as shown in FIGS. 1 and 2, walls can be run diagonally across the beam structures by again locating on the beams the projected wall line and then attaching the clips of the invention. The diagonal dimension of the base 53 is such that it still falls within the finished wall thickness so again, although the base of the clip is positioned diagonally with respect to the wall direction, the clip remains hidden.

It should be understood that hooks 52 will be formed of a dimension and so spaced as will be the locking tab 76, to conform to the various cross-sectional dimensions of different size and shape flanges. However, the controlling concept is the diagonally positioned hooks with corresponding locking tabs which extend from a flat base and which are locked to the structural beams from below by simple rotation.

I claim:

1. A connection between (1) a suspended ceiling of the grid type having (a) interlocking grid beams, a beam having (1) an inverted, generally T-shaped cross section that includes an upper web portion and a lower opposing flange portion at the bottom of the web portion, wherein the suspended ceiling extends continuously horizontally over a given certain area, and (2) a partition wall (a) extending vertically within and below the given ceiling area, (b) having an inverted upper U-shaped channel (1) intended to abut against and extend horizontally beneath the suspended ceiling, (2) forming the top structural member of the partition wall; and (3) intended to be erected before the remainder of the partition wall is erected;

comprising, in combination, (A) a clip having (1) a flat metal base having a maximum dimension less than the width of the channel, (2) a pair of hooks positioned diagonally from one another in the base, (a) integral with the flat metal base, (b) having a portion on each of the hooks extending toward each other, (c) spaced laterally apart a distance generally conforming to the width of the opposing flanges of the beam, (d) adapted to be hooked onto the flanges of the beam by rotating the base, and (3) locking tabs (a) integral with the base (b) that permit the base to be rotated to apply the clip on the beam, but (c) prevent the clip from being rotated to unhook the clip from the beam after the clip has been applied, and (B) fastening means for securing the clip to the partition wall extending through the base of the U-shaped channel into the base of the clip, wherein said means can be applied (1) after the clip has been locked to the grid member, (2) from inside the inverted U-shaped channel, and (3) before the remainder of the partition wall is erected.

2. A clip of claim 1 wherein the base is rectangular.

3. A clip of claim 1 wherein the hooks and locking tabs are stamped from the base.

* * * * *